US006476700B2

(12) United States Patent
Schauwecker et al.

(10) Patent No.: US 6,476,700 B2
(45) Date of Patent: Nov. 5, 2002

(54) DIMENSIONING OF ADDITIONAL CURRENT PATHS TO OPTIMIZE THE DISTURBANCE BEHAVIOR OF A SUPERCONDUCTING MAGNET SYSTEM

(75) Inventors: Robert Schauwecker; Pierre-Alain Bovier; Andreas Amann, all of Zurich; Werner Tschopp, Forch, all of (CH)

(73) Assignee: Bruker AG, Fallanden (CH)

( * ) Notice: Subject to any disclaimer, the term of this patent is extended or adjusted under 35 U.S.C. 154(b) by 0 days.

(21) Appl. No.: 09/930,954

(22) Filed: Aug. 17, 2001

(65) Prior Publication Data

US 2002/0044034 A1 Apr. 18, 2002

(30) Foreign Application Priority Data

Aug. 24, 2000 (DE) ..... 100 41 677

(51) Int. Cl.[7] ..... H01F 6/00

(52) U.S. Cl. ..... 335/216; 335/301; 324/319; 324/320

(58) Field of Search ..... 335/216, 299, 335/301; 324/318, 319, 320

(56) References Cited

U.S. PATENT DOCUMENTS 4,926,289 A 5/1990 Reichert
4,974,113 A 11/1990 Gabrielse
5,329,266 A 7/1994 Soeldner

OTHER PUBLICATIONS

C. P. Bean "Magnetization of Hard Superconductors" Phys. Rev. Let 8, P 250 ff (1962).

C. P. Bean "Magnetization of High–Field Superconductors", Rev. Mod. Phys. 36, 31 (1964).

*Primary Examiner*—Ramon M. Barrera
(74) *Attorney, Agent, or Firm*—Paul Vincent

(57) ABSTRACT

A superconducting magnet system for generating a magnetic field in the direction of a z axis in a working volume disposed about z=0 with at least one current-carrying magnet coil (M) and with at least one additional, superconductingly closed current path (P1, . . . , Pn), which can react inductively to the changes of the magnetic flux through the area enclosed by it, wherein the magnetic fields in the z direction in the working volume which are produced by these additional current paths during operation and due to induced currents, do not exceed a magnitude of 0.1 Tesla, is characterized in that, when an additional disturbance coil (D) produces a substantially homogeneous disturbance field in the magnet volume, the diamagnetic expulsion of the disturbance field from the main magnet coil is taken into consideration when designing the magnet coil(s) and the current paths. This permits straightforward modification of a conventionally calculated magnet arrangement to optimize the actual disturbance behavior of the system.

18 Claims, 4 Drawing Sheets

DIMENSIONING OF ADDITIONAL CURRENT PATHS TO OPTIMIZE THE DISTURBANCE BEHAVIOR OF A SUPERCONDUCTING MAGNET SYSTEM

This application claims Paris Convention priority of DE 100 41 677.2 filed Aug. 24, 2000 the complete disclosure of which is hereby incorporated by reference.

BACKGROUND OF THE INVENTION

The invention concerns a superconducting magnet system for generating a magnetic field in the direction of a z axis in a working volume disposed about z=0, with at least one current-carrying magnet coil and at least one additional, superconductingly closed current path, which can react inductively to changes of the magnetic flux through the area enclosed by same, wherein the magnetic fields generated in the z direction in the working volume by these additional current paths during operation due to induced currents do not exceed 0.1 Tesla. The invention also concerns a method for dimensioning these additional current paths.

A device of this type is disclosed e.g. in U.S. Pat. No. 4,974,113-A.

Superconducting magnet arrangements of this type comprising actively shielded magnets are disclosed e.g. in U.S. Pat. No. 5,329,266 or U.S. Pat. No. 4,926,289.

Superconducting magnets are used for different applications, in particular, magnetic resonance methods, wherein the stability of the magnetic field over time is usually important. The most demanding applications are high-resolution nuclear magnetic resonance spectroscopy (NMR spectroscopy). Field fluctuations with time can be caused by the superconducting magnet itself and also by its surroundings. While modern magnet and conductor technology can produce fields which are very constant with time, there is still need for development in the field of suppression of external magnetic disturbances. We will describe means for counteracting these disturbances. The main focus thereby is disturbance compensation with superconducting solenoid magnets having active stray field shielding.

U.S. Pat. No. 4,974,113 describes i.a. a compensating superconducting solenoid magnet, however, without active shielding. At least two independent superconducting current paths are constructed using two coaxial superconducting solenoid coils and calculated such that external magnetic field disturbances occurring inside the arrangement are suppressed to a residual value in long-term behavior of not more than 20% of the original disturbance, thereby taking into consideration conservation of total magnetic flux for each closed superconducting current path. U.S. Pat. No. 4,974,113 further describes a method for calculating the disturbance behavior for such arrangements which is based on the principle of conservation of magnetic flux through a closed superconducting loop.

U.S. Pat. No. 5,329,266 describes an application of this idea to an actively shielded magnet system. A plurality of shielding, structured compensation coils are connected in superconducting series and have a current carrying capacity which is low compared to that of the main coils (on the order of at most one ampere) to ensure that, in case of a superconducting breakdown (=quench), the disturbance field outwardly radiated by the magnet arrangement remains as small as possible.

U.S. Pat. No. 4,926,289 shows an alternative approach which describes an actively shielded superconducting magnet system with a radially inner and a radially outer superconductingly short-circuited coil system, wherein a superconducting short-circuit with limited current carrying capacity is provided between the inner and the outer coil system, such that the current difference between the two coil systems is limited. To compensate for external disturbances, the superconducting current limiter between the two coil systems can produce a shift in the current distribution between the radially inner and the radially outer superconducting current path. In case of a quench, the small current carrying capacity of the current limiter ensures that the external stray field produced by the magnet arrangement remains small.

If additional current paths are dimensioned according to the above-mentioned teaching, the desired compensation effect is difficult to obtain in certain cases. With actively shielded magnets having only one individual superconductingly short-circuited current path, the observed disturbance behavior differs considerably from that calculated according to the above cited prior art. The reason therefor is that, in conventional methods for calculation of the disturbance behavior of a superconducting magnet arrangement, the superconductor is treated as non-magnetic material. The present invention also takes into consideration the fact that the superconductor mainly behaves as a diamagnetic material with respect to field fluctuations of less than 0.1 Tesla and thereby largely expels small field fluctuations from its volume. This results in a redistribution of the magnetic flux of the field fluctuations in the magnet arrangement which then influences the reaction of the superconducting magnet and additional superconductingly closed current paths to an external disturbance, since this reaction is determined by the principle of conservation of the magnetic flux through a closed superconducting loop.

In contrast thereto, it is the object of the present invention to modify a magnet arrangement of the above mentioned type with as easy and simple means as possible such that the disturbance behavior of the magnet system is corrected to an optimum degree by taking into consideration the diamagnetism of the superconductor. The object of the present invention is thereby not limited to modifying a magnet arrangement of the above mentioned type such that external field fluctuations in the working volume of the magnet arrangement are largely suppressed. Arrangements can also be designed which either amplify or weaken external field fluctuations to a certain degree. Such applications are desired e.g. when the external field fluctuation is generated by field modulation coils whose effect in the working volume should be as strong as possible.

SUMMARY OF THE INVENTION

This object is achieved in accordance with the invention in that the magnet coil(s) and the additional current path(s) are designed such that, in response to an additional disturbance coil which generates a substantially homogeneous disturbance field in the magnetic volume, the value β (that factor by which the disturbance is increased or weakened by the reaction of the magnet) is calculated according to $$\beta = 1 - g^T \cdot \left( (L^{cl} - \alpha L^{cor})^{-1} \frac{(L^{cl}_{\leftarrow D} - \alpha L^{cor}_{\leftarrow D})}{g_D} \right)$$

if and only if this value differs by more than 0.1 from a value $$\beta_0 = 1 - g^T \cdot \left( (L^{cl})^{-1} \frac{L^{cl}_{\leftarrow D}}{g_D} \right)$$

which would result if $\alpha=0$.

The above variables have the following definitions:

- $\alpha$: average magnetic susceptibility in the volume of the magnet coil(s) with respect to field fluctuations which do not exceed a magnitude of 0.1 T, wherein $0<\alpha\leqq 1$,
- $g^T=(g_M, g_{P1}, \ldots, g_{Pj}, \ldots g_{Pn})$,
- $g_{Pj}$: field per ampere of the current path Pj in the working volume without the field contributions of the current paths Pi for $i\neq j$ and the magnet coil(s),
- $g_M$: field per ampere of the magnet coil(s) in the working volume without the field contributions of the current paths,
- $g_D$: field per ampere of the disturbing coil in the working volume without the field contributions of the current paths and the magnet coil(s),
- $L^{cl}$: matrix of the inductive couplings between the magnet coil(s) and the current paths and among the current paths,
- $L^{cor}$: correction for inductance matrix $L^{cl}$, which would result with complete diamagnetic expulsion of disturbance fields from the volume of the magnet coil(s);
- $L_{\leftarrow D}{}^{cl}$: vector of inductive couplings between the disturbance coil and the magnet coil(s) and current paths;
- $L_{\leftarrow D}{}^{cor}$: correction for the coupling vector $L_{\leftarrow D}{}^{cl}$, which would result with complete diamagnetic expulsion of disturbance fields from the volume of the magnet coil(s).

To improve the disturbance behavior of the magnet, additional current paths are added to the superconducting magnet. These additional current paths must be correctly dimensioned in order to achieve the desired effect. According to the above-cited prior art, this would mean that their field efficiency $g_{Pj}$ and the field efficiency $g_M$ of the magnet as well as the mutual inductive couplings of the additional current paths among themselves, with the magnet and with the external field sources in addition to self-inductances are correctly calculated and taken into consideration when designing the coils of the current paths. However, when dimensioning the additional current paths in an inventive arrangement, in addition to the above-mentioned coil properties, the magnetic shielding behavior of the superconducting volume portion of the magnet is also taken into consideration.

This shielding behavior appears in all superconducting magnet systems, but only has significant effect on the disturbance behavior in special configurations. Only such special configurations are the object of the invention since, in all other arrangements, the dimensioning of the coil according to the cited prior art already produces satisfying results. The advantage of an inventive arrangement, in which the above-mentioned magnetic shielding behavior of the magnet has significant effect on the disturbance behavior of the arrangement, is that one can assure that the behavior of the arrangement in response to external magnetic disturbances corresponds to expectations. The present invention is thereby not limited to arrangements which largely suppress external field fluctuations in their working volume. On the contrary, it is also possible to design arrangements which amplify or weaken external field fluctuations to a certain extent.

One embodiment of the inventive magnet arrangement is particularly preferred with which the superconducting magnet comprises a radially inner and a radially outer coaxial coil system which are electrically connected in series, wherein these two coil systems each produce one magnetic field in the working volume with opposing direction along the z axis.

In such an arrangement, the magnetic shielding behavior of the superconductor in the magnet usually has a particularly strong effect on the disturbance behavior of the magnet arrangement.

In a further development of this embodiment, the radially inner coil system and the radially outer coil system have dipole moments of approximately equal and opposite strength. This is the condition for optimum suppression of the stray field of the magnet. Due to the large technical importance of actively shielded magnets, the correct dimensioning of additional coils in such magnets, including those cases where the above-mentioned magnetic shielding behavior of the superconductor in the magnet significantly influences the effect of the additional current paths, is very advantageous.

In another advantageous further development of the above-mentioned embodiment, the magnet coil(s) form(s) a first current path which is superconductingly short-circuited during operation and a disturbance compensation coil, which is not galvanically connected to the magnet, is disposed coaxially with respect to the magnet to form a further current path which is superconductingly short-circuited during operation. This embodiment constitutes a simple, realistic solution with only two superconductingly closed current paths. Only one single superconducting current path is provided in addition to the superconducting path of the magnet itself.

In a further advantageous development, at least one of the additional current paths is a portion of the magnet bridged with a superconducting switch. This permits optimization of the disturbance behavior of the magnet arrangement without providing additional coils.

In a particularly preferred embodiment of the inventive magnet arrangement, the current paths which are superconductingly short-circuited during operation are substantially inductively decoupled. In this manner, charging does not produce mutual induction of currents which would be converted into a great amount of heat in the open switches. Moreover, drifting superconducting current paths do not influence one another which could otherwise lead e.g. to a monotonically increasing charging of a coil. During a quench of a superconducting current path, e.g. the magnet, no enhanced stray field is suddenly produced by another current path, such as a compensation coil.

In a particularly advantageous further development of this magnet arrangement, a different polarity of the radially inner coil system and the radially outer coil system is used for inductive decoupling. The utilization of the different polarities of stray field shielding and main coil facilitates the design of magnet arrangements in accordance with the above-described embodiment.

The above-mentioned advantages of the invention are particularly important in sensitive systems. For this reason, in a preferred embodiment, the inventive magnet arrangement is part of an apparatus for high-resolution magnetic resonance spectroscopy, e.g. in the field of NMR, ICR or MRI.

In an advantageous further development of this embodiment, the magnetic resonance apparatus comprises a means for field locking the magnetic field generated in the working volume. Optimization of the disturbance behavior of the magnet arrangement with additional current paths effectively supports the NMR lock.

It should, however, be guaranteed that existing active devices for compensating magnetic field fluctuations, such as the NMR lock, do not interact with the inventive method for eliminating disturbances of the magnet. For this reason, a further development of the above embodiment provides that the inductive couplings between the superconducting current paths and the lock coil are small compared to the corresponding self-inductances of the superconducting current paths. By inductively decoupling the superconducting current paths from the lock coil the effect of the NMR lock is advantageously not impaired by the superconducting current paths.

In another improved further development, the magnet arrangement can also comprise field modulation coils. In such an arrangement, the present invention can guarantee that the superconducting current paths neither obstruct nor amplify the effect of the field modulation coils in the working volume of the magnet arrangement.

In a further advantageous embodiment of the invention, at least one of the additional current paths comprises a superconductingly closed coil which is electrically separated from the magnet arrangement. The use of several additional current paths offers more possibilities to optimize the disturbance behavior of the magnet arrangement.

One embodiment of the inventive magnet arrangement is also of particular advantage wherein the absolute value of $$\beta = 1 - g^T \cdot \left( (L^{cl} - \alpha L^{cor})^{-1} \frac{(L^{cl}_{\leftarrow D} - \alpha L^{cor}_{\leftarrow D})}{g_D} \right)$$

is smaller than 0.1. Under this condition, external field fluctuations in the working volume of the magnet arrangement are reduced by more than 90 percent. This is desirable for most applications.

The present invention also concerns a method for dimensioning the additional current paths in a magnet arrangement, wherein the portion β of an external field disturbance which enters the working volume of the magnet system, is calculated taking into consideration the current changes induced in the magnet and the additional current paths according to $$\beta = 1 - g^T \cdot \left( (L^{cl} - \alpha L^{cor})^{-1} \frac{(L^{cl}_{\leftarrow D} - \alpha L^{cor}_{\leftarrow D})}{g_D} \right),$$

wherein the variables have the above-mentioned definition. This method for dimensioning the additional current paths advantageously takes the magnetic shielding behavior of the superconductor in the magnet into consideration. All embodiments of the invention can be dimensioned with this method through calculation of the behavior of the magnet system when external field disturbances occur thereby taking into consideration the current changes induced in the magnet and in the additional current paths. The method is based on the calculation of correction terms for the mutual inductive couplings among the additional current paths themselves and with the magnet and the external field sources as well as for all self-inductances, these correction terms being weighted with a factor α and subtracted from their corresponding classically calculated quantities. This method achieves a better correspondence between calculated and measurable disturbance behavior of the magnet arrangement than does the conventional method.

In a simple variant of the inventive method, the parameter α corresponds to the volume portion of superconductor material in the coil volume of the magnet. This method for determining the parameter α is based on the assumption that the susceptibility in the superconductor with respect to field fluctuations is (−1) (ideal diamagnetism).

The values for α determined in this fashion cannot be experimentally confirmed for most magnet types. A particularly preferred alternative method variant is therefore characterized in that the parameter α is experimentally determined for the magnet arrangement from the measurement of the value $\beta^{exp}$ of the magnet coil(s), with no additional current paths, in response to a disturbance coil producing a substantially homogeneous disturbance field in the magnet volume, with insertion of the value $\beta^{exp}$ into the equation $$\alpha = \frac{g_D (L^{cl}_M)^2 (\beta^{exp} - \beta^{cl})}{g_D (\beta^{exp} - \beta^{cl}) L^{cl}_M L^{cor}_M - g_M (L^{cl}_{M\leftarrow D} L^{cor}_M - L^{cor}_{M\leftarrow D} L^{cl}_M)},$$

wherein $$\beta^{cl} = 1 - g_M \cdot \left( \frac{L^{cl}_{M\leftarrow D}}{L^{cl}_M \cdot g_D} \right),$$

$g_M$: field per ampere of the magnet coil(s) in the working volume, $g_D$: field per ampere of the disturbance coil in the working volume without the field contribution of the magnet coil(s), $L_M^{cl}$: inductance of the magnet coil(s)

$L_{M\leftarrow D}^{cl}$: inductive coupling of the disturbance coil with the magnet coil(s), $L_M^{cor}$: correction for the magnet inductance $L_M^{cl}$, which would result with complete diamagnetic expulsion of disturbance fields from the volume of the magnet coil(s), $L_{M\leftarrow D}^{cor}$: correction for inductive coupling $L_{M\leftarrow D}^{cl}$ between the disturbance coil and the magnet coil(s) which would result for complete diamagnetic expulsion of disturbing fields from the volume of the magnet coil(s), $$\beta^{exp} = \frac{g_D^{eff}}{g_D},$$

$g_D^{eff}$: measured field change in the working volume of the magnet arrangement per ampere of current in the disturbance coil.

Finally, in a further particularly preferred variant of the inventive method, the corrections $L^{cor}$, $L_{\leftarrow D}^{cor}$, $L_M^{cor}$ and $L_{M\leftarrow D}^{cor}$ are calculated as follows:

$$L^{cor} = \begin{pmatrix} L^{cor}_M & L^{cor}_{M\leftarrow Pl} & \cdots & L^{cor}_{M\leftarrow Pn} \\ L^{cor}_{Pl\leftarrow M} & L^{cor}_{Pl} & \cdots & L^{cor}_{Pl\leftarrow Pn} \\ \vdots & \vdots & \ddots & \vdots \\ L^{cor}_{Pn\leftarrow M} & L^{cor}_{Pn\leftarrow Pl} & \cdots & L^{cor}_{Pn} \end{pmatrix}$$

$$L^{cor}_{\leftarrow D} = \begin{pmatrix} L^{cor}_{M\leftarrow D} \\ L^{cor}_{Pl\leftarrow D} \\ \vdots \\ L^{cor}_{Pn\leftarrow D} \end{pmatrix}$$

$$L_{Pj\leftarrow Pk}^{cor} = f_{Pj}(L_{(Pj,red,Ra_1)\leftarrow Pk}^{cl} - L_{(Pj,red,Ri_1)\leftarrow Pk}^{cl})$$

$$L_{Pj\leftarrow D}^{cor} = f_{Pj}(L_{(Pj,red,Ra_1)\leftarrow D}^{cl} - L_{(Pj,red,Ri_1)\leftarrow D}^{cl})$$

$$L_{Pj\leftarrow M}^{cor} = f_{Pj}(L_{(Pj,red,Ra_1)\leftarrow M}^{cl} - L_{(Pj,red,Ri_1)\leftarrow M}^{cl})$$

$$L^{cor}_{M\leftarrow Pj} = L^{cl}_{1\leftarrow Pj} - L^{cl}_{(1,red,Ri_1)\leftarrow Pj} + \frac{Ra_1}{R_2}\left(L^{cl}_{(2,red,Ra_1)\leftarrow Pj} - L^{cl}_{2,red,Ri_1)\leftarrow Pj}\right)$$

$$L^{cor}_{M\leftarrow D} = L^{cl}_{1\leftarrow D} - L^{cl}_{(1,red,Ri1)\leftarrow D} + \frac{Ra_1}{R_2}\left(L^{cl}_{(2,red,Ra_1)\leftarrow D} - L^{cl}_{2,red,Ri_1)\leftarrow D}\right)$$

$$L_M{}^{cor} = L_{1\leftarrow 1}{}^{cl} - L_{(1,red,Ri1)\leftarrow 1}{}^{cl} + L_{1\leftarrow 2}{}^{cl} - L_{(1,red,Ri1)\leftarrow 2}{}^{cl}$$

$$L^{cor}_M = L^{cl}_{1\leftarrow 1} - L^{cl}_{(1,red,Ri1)\leftarrow 1} + L^{cl}_{1\leftarrow 2} - L^{cl}_{(1,red,Ri1)\leftarrow 2} + \frac{Ra_1}{R_2}\left(L^{cl}_{(2,red,Ra_1)\leftarrow 2} - L^{cl}_{(2,red,Ri_1)\leftarrow 2} + L^{cl}_{(2,red,Ra_1)\leftarrow 1} - L^{cl}_{(2,red,Ri_1)\leftarrow 1}\right)$$

wherein $Ra_1$: outer radius of the magnet coil(s) (in case of an actively shielded magnet arrangement, the outer radius of the main coil), $Ri_1$: inside radius of the magnet coil(s), $R_2$: in case of an actively shielded magnet arrangement the medium radius of shielding, otherwise infinite, $R_{Pj}$: medium radius of the additional coil Pj, $$f_{Pj} = \begin{cases} \frac{Ra_1}{R_{Pj}}, & R_{Pj} > Ra_1 \\ 1, & R_{Pj} < Ra_1 \end{cases},$$

wherein the index 1 designates the main coil for an actively shielded magnet arrangement, and otherwise designates the magnet coil(s), and the index 2 designates the shielding of an actively shielded magnet arrangement, wherein terms with index 2 are otherwise omitted and the index (X, red, R) designates a hypothetical coil X whose entire windings are wound at the radius R.

The particular advantage of this method for calculating the corrections $L^{cor}$, $L_{\leftarrow D}{}^{cor}$, $L_M{}^{cor}$ and $L_{M\leftarrow D}{}^{cor}$ consists in that the corrections are based on the inductive couplings and the self-inductance of coils, taking into consideration their geometrical arrangement.

Further advantages of the invention can be extracted from the description and the drawing. The features mentioned above and below can be used in accordance with the invention either individually or collectively in any arbitrary combination. The embodiments shown and described are not to be understood as exhaustive enumeration but rather have exemplary character for describing the invention.

The invention is shown in the drawing and explained in more detail with respect to embodiments.

DESCRIPTION OF THE PREFERRED EMBODIMENT

Figure 1:
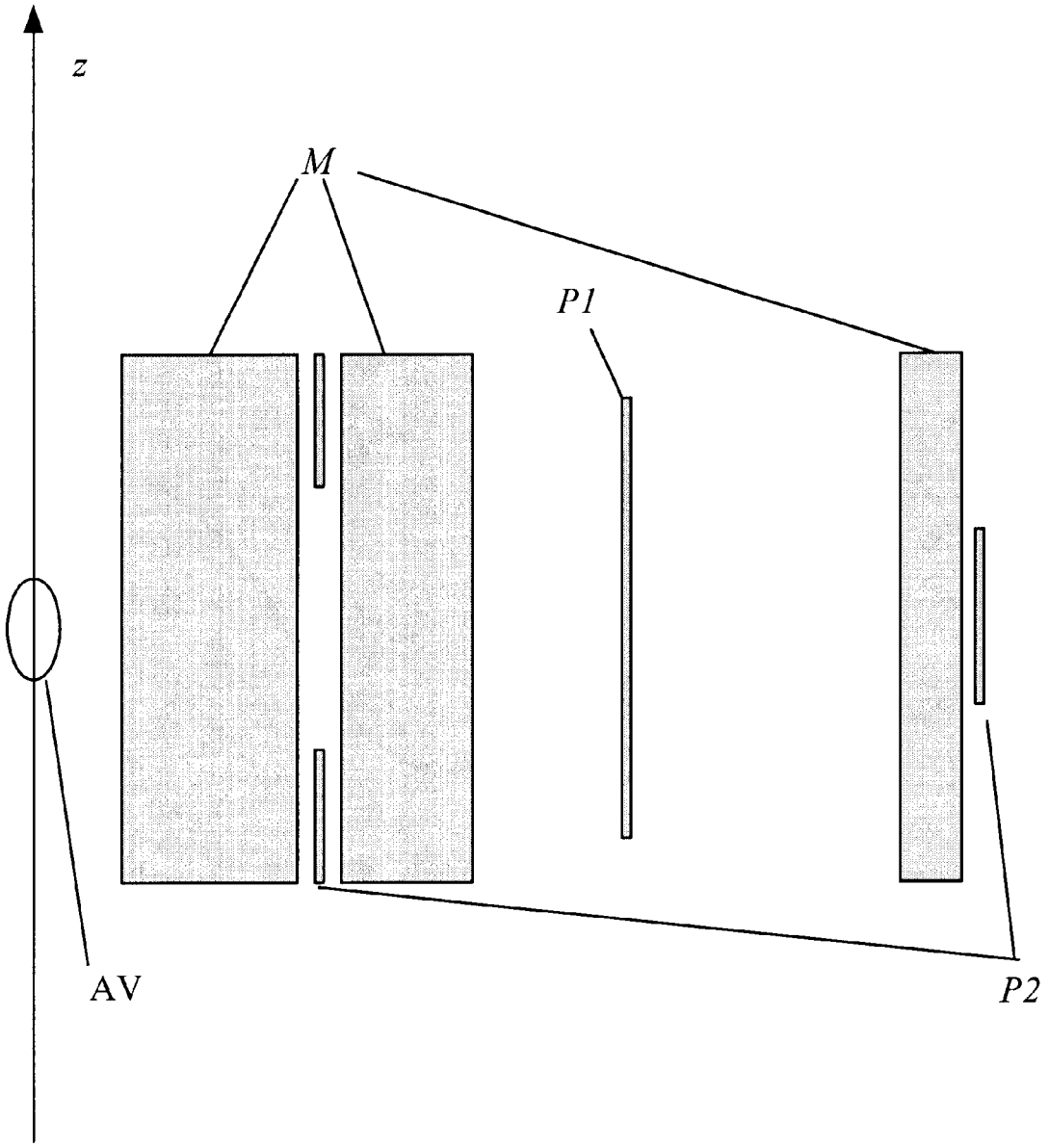
FIG. 1 shows a schematical vertical section through a radial half of the inventive magnet arrangement for generating a magnetic field in the direction of a z axis in a working volume AV disposed about z=0 with a magnet M and additional superconductingly closed current paths P1,P2.

In the inventive magnet arrangement of FIG. 1, the superconducting magnet M and the additional current paths P1,P2 can be composed of several partial coils which are distributed at different radii. The partial coils may have different polarities. All partial coils are coaxially disposed about a working volume AV located on an axis z and proximate z=0. The smaller coil cross-section of the additional coils P1,P2 in FIG. 1 indicates that the additional coils P1,P2 only generate weak magnetic fields, with the main field being produced by the magnet M.

Figure 2:
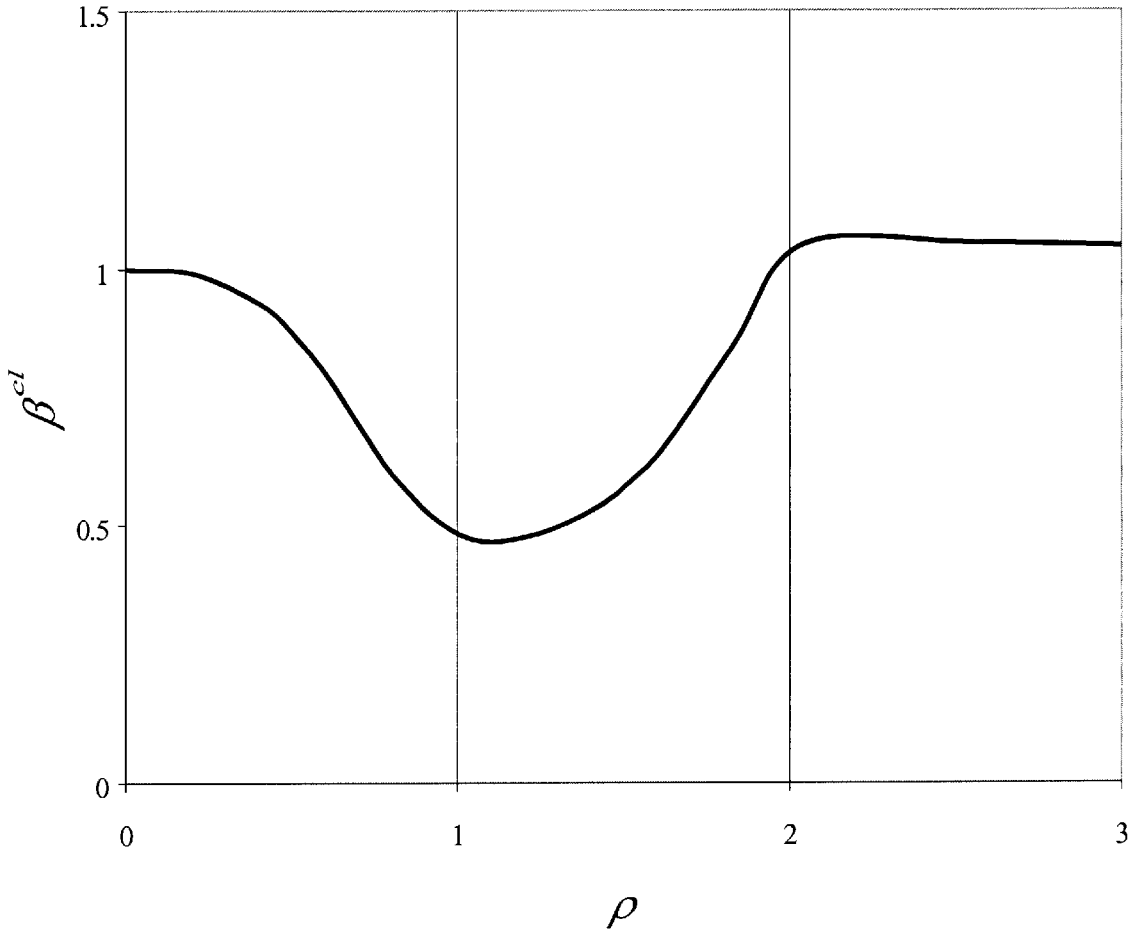
FIG. 2 shows the calculated beta factor $\beta^{cl}$ for an actively shielded magnet, without additional current paths, as a function of the reduced radius ρ of a disturbance loop (radius normalized to the outside radius of the main coil)
Figure 3:
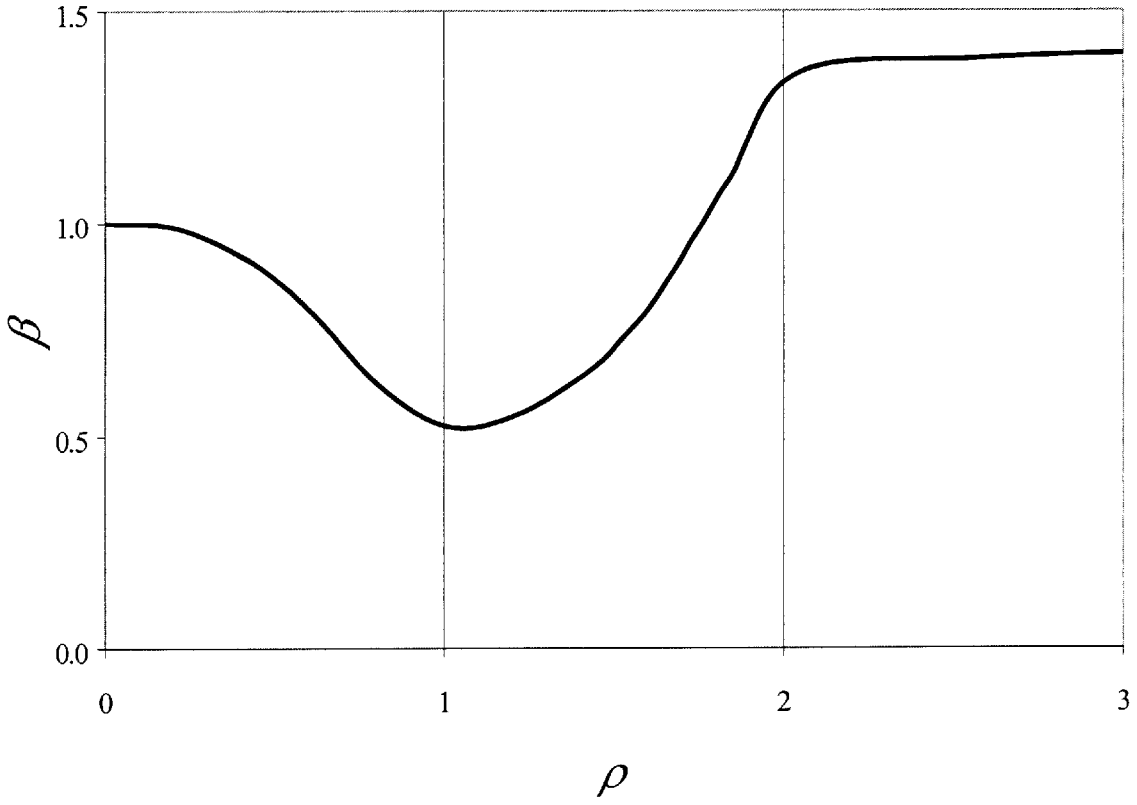
FIG. 3 shows the beta factor β calculated according to the inventive method with α=0.33 as a function of the reduced radius ρ of a disturbance loop (radius normalized to the outside radius of the main coil)
Figure 4:
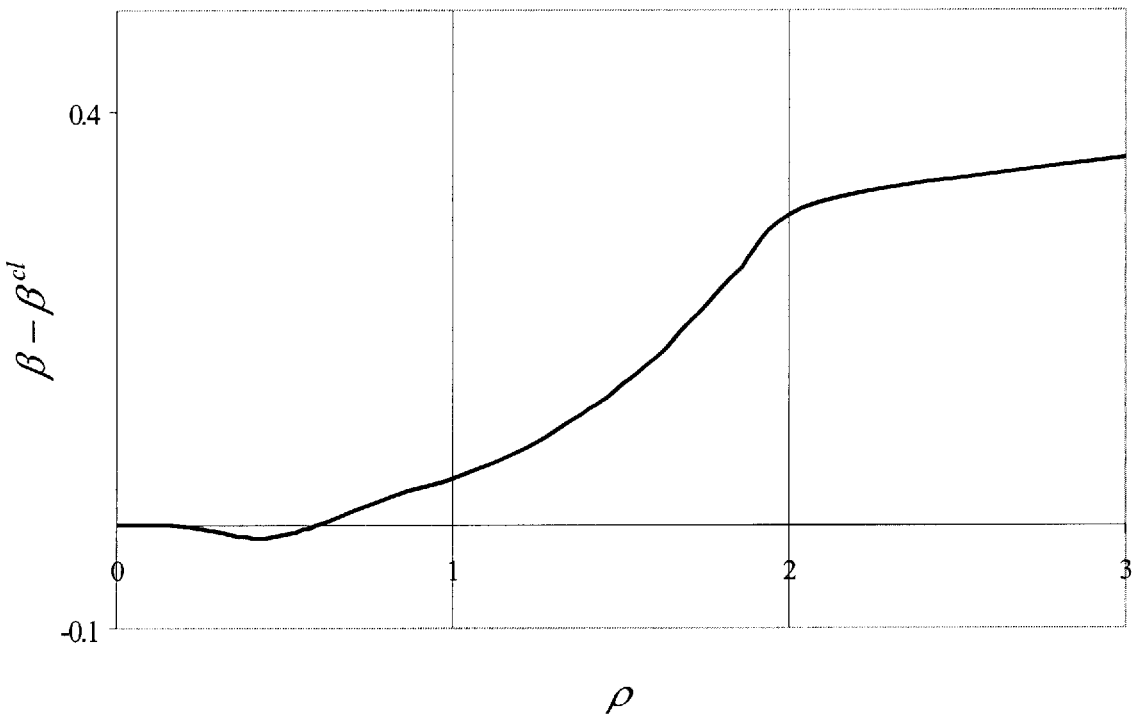
FIG. 4 shows the difference between the values β and $\beta^{cl}$ as a function of the reduced radius ρ of a disturbance loop (radius normalized to the outside radius of the main coil).

With respect to FIGS. 2 to 4, the functions $$\beta^{cl} = 1 - g_M \cdot \left(\frac{L^{cl}_{M\leftarrow D}}{L^{cl}_M \cdot g_D}\right)$$

and $$\beta = 1 - g^T \cdot \left((L^{cl} - \alpha L^{cor})^{-1} \frac{(L^{cl}_{\leftarrow D} - \alpha L^{cor}_{\leftarrow D})}{g_D}\right)$$

are compared in dependence on the radius of a disturbance loop D, coaxial to the magnet arrangement. The values $\beta^{cl}$ and β simulate the portion of the disturbance field of the coil D which can be measured in the working volume using the method of the above-mentioned prior art and the inventive method. These calculations were carried out for a magnet arrangement having an actively shielded superconducting magnet M without additional current paths, wherein the radius of the active shielding corresponds to twice the outer radius of the main coil of the magnet M. The dipole moments of main coil and shielding coil are equal and opposite. It turns out that, due to the correction terms in accordance with the inventive method which were weighted with α=0.33, a deviation of approximately 40 percent results for the disturbance behavior of the magnet arrangement for large radii of the disturbance loop D compared to the method according to the cited prior art. The experimentally observed disturbance behavior of such a magnet arrangement can be reproduced with a value α=0.33, whereas there is an inexplicable discrepancy between measurement and simulation of the disturbance behavior of the magnet arrangement using the method according to the cited prior art. The value α=0.33 roughly corresponds to the superconductor content of the coil volume of the magnet.

Some terms are now defined to simplify subsequent discussion:

An actively shielded magnet M consists of a radially inner coil system C1, designated below as the main coil, and a radially outer coil system C2, designated below as the shielding coil. These coils are disposed axially symmetric to a z axis and produce magnetic fields of opposing directions in a volume disposed about z=0, subsequently referred to as the working volume of the magnet. An unshielded magnet M is considered as a special case with a negligible outer coil system C2.

A disturbance field is defined as either an electromagnetic disturbance which is caused outside of the magnet system or a field which is produced by additional coils which do not belong to the magnet M and whose field contribution does not exceed 0.1 T.

To obtain formulas which are as compact and clear as possible, the following indices are used in this embodiment:

1 Main coil
2 Shielding coil
M Magnet C1, C2
D Disturbance
P Additional superconducting current path
cl Value calculated according to the cited prior art
cor Correction terms in accordance with the present invention For additional superconducting current paths, the indices P1, P2, . . . are used.

When calculating the behavior of a superconducting coil in a disturbance field according to the cited prior art, the superconductor is modeled as a material without electrical resistance. In a model of this type, an actively shielded superconducting magnet is substantially transparent to homogeneous disturbing fields in the region of the magnet since the voltage induced in the shielding coil by the disturbance field counteracts the induced voltage in the main coil and is typically of the same magnitude and the current in the magnet remains substantially unchanged. However, experiments show considerable deviations from this simple model. In general, it can be observed that actively shielded magnets amplify homogeneous disturbances. This is due to the additional properties of the superconductor which are not contained in the simple model of a conductor without electric resistance (called the classical model below). These additional properties of the superconductor not only have an effect on the disturbance behavior of the actively shielded magnet but must also be taken into consideration for correct dimensioning of additional coils in a shielded magnet. This effect also occurs with unshielded superconducting magnets. The resulting deviation from the classical model is small in most cases and therefore of little importance.

Since the field of the superconducting magnet in the working volume is stronger by orders of magnitude than the disturbance field, only the component which is parallel to the field of the magnet (herein called z component) of the disturbance field has an effect on the total field contribution. For this reason, we consider only $B_z$— disturbance fields below.

As soon as a disturbance field occurs at the location of a superconducting magnet M, a current is induced in the superconductingly short-circuited magnet M in accordance with Lenz's law, which generates a compensation field opposite to the disturbance field. The field change resulting in the working volume is therefore a superposition of the disturbance field $\Delta B_{z,D}$ and the compensation field $\Delta B_{z,M}$.

As a measure of the disturbance behavior of a magnet arrangement, we define the beta factor β as the ratio between the total $B_z$– field change ($\Delta B_{z,total}$) in the working volume of the magnet arrangement taking into consideration the magnet reaction, to the $B_z$– field change without that reaction:

$$\beta = \frac{\Delta B_{z,total}}{\Delta B_{z,D}} = \frac{\Delta B_{z,D} + \Delta B_{z,M}}{\Delta B_{z,D}} = 1 + \frac{\Delta B_{z,M}}{\Delta B_{z,D}}$$

The beta factor describes the capability of a coil to compensate external disturbances in the working volume. If e.g. β=0, the disturbance is invisible in the working volume. β>0 means that the induced current in the magnet under-compensates for the disturbance. However, β<0 means that the induced current is so large that the disturbance in the working volume is over-compensated.

Using the field efficiency $g_M$, which characterizes the field of the magnet in the working volume in the z direction per ampere of current, and the compensation current $\Delta I_M$ induced in the magnet by the disturbance, the beta factor can be formulated:

$$\beta = 1 + \frac{g_M \cdot \Delta I_M}{\Delta B_{z,D}}. \tag{1}$$

An arbitrary disturbance source is modeled below by an electric circuit which generates a field in the magnet volume which is identical to that of the real disturbance field. The disturbance of the disturbance circuit is produced by the current $\Delta I_D$. In the classical model, the compensation current in the magnet $\Delta I_M$ is:

$$\Delta I_M^{cl} = -\Delta I_D \cdot \frac{L_{M\leftarrow D}^{cl}}{L_M^{cl}} \tag{2}$$

with $L_M^{cl}$ (classical) self-inductance of the magnet, $L_{M\leftarrow D}^{cl}$ (classical) inductive coupling between the magnet and the disturbance circuit.

The classical inductive coupling is modified by an additional amount by taking into consideration the above-mentioned special properties of the superconductor. The same is true for the self-inductance of the magnet. For this reason, the current induced in the magnet will generally assume a different value than that calculated classically.

In the classical model the following relation is given for the beta factor $\beta^{cl}$ using equations (1) and (2):

$$\beta_{cl} = 1 - \Delta I_D \cdot \frac{g_M}{\Delta B_{z,D}} \cdot \frac{L_{M\leftarrow D}^{cl}}{L_M^{cl}} = 1 - \frac{g_M}{g_D} \cdot \frac{L_{M\leftarrow D}^{cl}}{L_M^{cl}} \tag{3}$$

If several superconductingly short-circuited current paths M, P1, . . . , Pn are present in the magnet system, formula (3) is generalized to $$\beta_{cl} = 1 - g^T \cdot \left( L_{cl}^{-1} \frac{L_{\leftarrow D}^{cl}}{g_D} \right) \tag{4}$$

with the values:

$g_D$: field per ampere of the coil D in the working volume without the field contributions of the currents induced in the additional current paths P1, . . . , Pn and in the magnet M, $$g^T = (g_M, g_{P1}, \ldots, g_{Pj}, \ldots, g_{Pn}),$$

wherein:

$g_M$: field per ampere of the magnet in the working volume without the field contributions of the currents induced in the additional current paths P1, . . . , Pn $g_{Pj}$: field per ampere of the current path Pj in the working volume without the field contributions of the currents induced in the other additional current paths P1, . . . , Pn and in the magnet M, $$L^{cl} = \begin{pmatrix} L_M^{cl} & L_{M\leftarrow P1}^{cl} & \cdots & L_{M\leftarrow Pn}^{cl} \\ L_{P1\leftarrow M}^{cl} & L_{P1}^{cl} & \cdots & L_{P1\leftarrow Pn}^{cl} \\ \vdots & \vdots & \ddots & \vdots \\ L_{Pn\leftarrow M}^{cl} & L_{Pn\leftarrow P1}^{cl} & \cdots & L_{Pn}^{cl} \end{pmatrix}$$

Matrix of the (classical) inductive couplings between the magnet M and the current paths P1, . . . , Pn and among the current paths P1, . . . , Pn, $(L^{cl})^{-1}$ Inverse of the matrix $L^{cl}$, $$L_{\leftarrow D}^{cl} = \begin{pmatrix} L_{M\leftarrow D}^{cl} \\ L_{P1\leftarrow D}^{cl} \\ \vdots \\ L_{Pn\leftarrow D}^{cl} \end{pmatrix},$$

wherein:

$L_{Pj\leftarrow D}{}^{cl}$ (classical) inductive coupling of the current path Pj with the coil D, $L_{M\leftarrow D}{}^{cl}$ (classical) inductive coupling of the magnet M with the coils D.

Type-I superconductors completely expel the magnetic flux from their inside (Meissner effect). For type-II superconductors, this is no longer the case above the lower critical field $H_{c1}$. According to the Bean model (C. P. Bean, Phys. Rev. Lett. 8, 250 (1962), C. P. Bean, Rev. Mod. Phys. 36, 31 (1964)) the magnetic flux lines adhere to the so-called "pinning centers". Small flux changes are trapped by the "pinning centers" on the surface and do not reach the inside of the superconductor. As a result, the disturbance fields are partly expelled from the superconductor volume. A type-II superconductor reacts diamagnetically to small field fluctuations, whereas larger field changes substantially enter the superconducting material. This effect is not taken into consideration in the classical model of the disturbance behavior of the magnet.

To permit calculation of this expulsion of small disturbance fields from the superconductor volume, we make various assumptions. Firstly, we assume that the major portion of the entire superconductor volume in a magnet system is concentrated in the main coil and that the superconductor volume in the shielding coil and in further superconducting current paths can be neglected.

We also assume that all field fluctuations in the volume of the main coil are reduced, relative to the value which they would have without the diamagnetic shielding of the superconductor, by a constant factor $(1-\alpha)$ with $0<\alpha<1$. We assume, however, that there is no reduction in the disturbing fields in the free inner bore of the main coil (radius $Ri_1$) due to the superconductor diamagnetism. The field lines expelled from the main coil accumulate beyond the outer radius $Ra_1$ of the main coil and the disturbance field is increased in this region. We further assume that this disturbance field excess outside of $Ra_1$ decreases with increasing r from the magnet axis from a maximum value at $Ra_1$ as $(1/r^3)$ (dipole behavior). The maximum value at $Ra_1$ is normalized such that the increase in the disturbance flux outside of $Ra_1$ exactly compensates for the reduction in the disturbance flux within the superconductor volume of the main coil (conservation of flux).

The redistribution of magnetic flux caused by a superconductor volume with diamagnetic behavior in response to small field fluctuations leads to changes in the inductive couplings and self-inductances of coils in the region of the superconductor volume. For an unshielded superconducting magnet M which is disturbed by an external magnetic field source D, the disturbance flux through the magnet windings is reduced and therefore the coupling disturbance→magnet $L_{M\leftarrow D}$. On the other hand, the flux of the field of a current induced in the magnet is reduced through the magnet windings to the same extent and therefore also the self-inductance $L_M$ of the magnet. The corrections for the classical values $L_{M\leftarrow D}{}^{cl}$ and $L_M{}^{cl}$ therefore cancel in equation (3) and therefore the described superconductor diamagnetism does not manifest itself in the disturbance behavior of an unshielded superconducting magnet.

The disturbance flux of an external field source D is also expelled from the superconductor volume of the main coil in actively shielded magnets. The expelled flux is concentrated directly beyond the outside radius $Ra_1$ of the main coil and therefore remains largely within the inner radius $Ri_2$ of the shielding coil, since typically $Ri_2 >> Ra_1$ which means that among all couplings and self-inductances, the coupling $L_{2\leftarrow D}$ between the disturbance and the shielding is reduced the least due to the disturbance flux expulsion from the superconductor volume of the main coil. In the classical model, actively shielded magnets are practically transparent to disturbances since the induced voltages in the main coil and shielding largely compensate each other thereby suppressing a reaction of the magnet to the disturbance. The above-described flux displacement from the superconductor volume of the main coil causes the contribution of the shielding to prevail in the overall voltage induced in the magnet by the disturbance. This leads to the experimentally observed significant increase of the disturbance in the working volume of the magnet.

In order to extend the classical model of the disturbance behavior of a superconducting magnet arrangement taking into consideration the influence of superconductor diamagnetism, it is sufficient to determine the actual correction term for each coupling or self-inductance term of formula (4). The structure of the equation does not change. The correction terms are derived below for all couplings and inherent inductances.

The principle of calculation of the correction terms is the same in all cases, i.e. determination of the reduction of the magnetic flux through a coil due to a small current change in another (or in itself) due to the diamagnetic reaction of the superconducting material in the main coil of the magnet system. The coupling between the first and the second coil (and self-inductance) is correspondingly reduced. The size of the correction term depends on the portion of the volume filled with superconducting material of the main coil within the inductively reacting coil, compared to the total volume enclosed by the coil.

The relative position of the coils with respect to one another also has an influence on the correction term for their mutual inductive coupling.

The introduction of "reduced coils" has proven to be a useful aid for calculating the correction terms. The coil X, reduced to the radius R, is that hypothetical coil having all windings of the coil X at radius R. The index "X,red,R" is used as notation for this coil. Through use of reduced coils, when the flux through a coil changes, the contributions of the flux change through partial areas of this coil to the total flux change can be calculated.

First of all, the correction term for the coupling of an external disturbing source D with the main coil C1 of the magnet system (shielded or unshielded) is calculated.

In the volume of the main coil C1, the disturbance field $\Delta B_{z,D}$ is reduced on the average by the amount $\alpha \cdot \Delta B_{z,D}$, wherein $0<\alpha<1$ is a still unknown parameter. Consequently, the disturbing flux through the main coil C1 and thereby the inductive coupling $L_{1\leftarrow D}$ between main coil and disturbance source is weakened by a factor $(1-\alpha)$ with respect to the classical value $L_{1\leftarrow D}^{cl}$ if the disturbance field in the inner bore of the main coil is also considered to have been reduced by the factor $(1-\alpha)$. We assume, however, that the flux of the disturbance is not expelled from the inner bore of the magnet. For this reason, the coupling between the disturbance and the main coil must be supplemented by the portion erroneously deducted from the inner bore. In accordance with the definition of "reduced coils", this contribution is $\alpha\cdot L_{(1,red,Ri1)\leftarrow D}^{cl}$, wherein $L_{(1,red,Ri1)\leftarrow D}^{cl}$ is the coupling of the disturbance to the main coil C1, reduced to its inner radius $Ri_1$. Taking into consideration the disturbance field expulsion from the superconductor volume of the main coil, the inductive coupling $L_{1\leftarrow D}$ between the main coil and disturbance source is therefore:

$$L_{1\leftarrow D}=(1-\alpha)\cdot L_{1\leftarrow D}^{cl}+\alpha L_{(1,red,Ri1)\leftarrow D}^{cl} \tag{5}$$

The displaced flux reappears radially beyond the outside radius of the main coil $Ra_1$. Assuming that the displaced field exhibits dipole behavior (decrease with $(1/r^3)$), one obtains the following additional contribution to the classical disturbance field outside of the main coil $$\alpha\frac{Ra_1}{r^3}\int_{Ri_1}^{Ra_1}\Delta B_{z,D}R\,dR. \tag{6}$$

This function is normalized such that the entire flux of the disturbance through a large loop of radius R goes to zero for $R\rightarrow\infty$. The disturbance field $\Delta B_{z,D}$ is assumed to be cylindrically symmetric.

In the case of an actively shielded magnet, the disturbance flux through the shielding coil C2 is also reduced due to the expulsion of the disturbance flux from the main coil C1. Expressed more precisely, the disturbance flux through a winding of a radius $R_2$ at the axial height $z_0$ is reduced with respect to the classical case by the following amount (integral of (6) over the region $r>R_2$):

$$2\pi\alpha\int_{R_2}^{\infty}\frac{Ra_1}{r^2}dr\int_{Ri_1}^{Ra_1}\Delta B_z^D R\,dR = 2\pi\alpha\frac{Ra_1}{R_2}\int_{Ri_1}^{Ra_1}\Delta B_z^D R\,dR=\alpha\frac{Ra_1}{R_2}\left(\Phi_{(2,red,Ra_1)\leftarrow D}^{cl}-\Phi_{(2,red,Ri_1)\leftarrow D}^{cl}\right)$$

$\Phi_{(2,red,Ra_1)\leftarrow D}^{cl}$ characterizes the classical disturbance flux through a loop of radius $Ra_1$, which is at the same axial height $z_0$ as the considered loop of radius $R_2$ (analogously for $Ri_1$). Summing over all windings of the shielding coil (which are approximately all at the same radius $R_2$) one obtains the following mutual coupling between the disturbing loop and the shielding coil:

$$L_{2\leftarrow D}=L_{2\leftarrow D}^{cl}-\alpha\frac{Ra_1}{R_2}\left(L_{(2,red,Ra_1)\leftarrow D}^{cl}-L_{(2,red,Ri_1)\leftarrow D}^{cl}\right)$$

$L_{(2,red,Ra_1)\leftarrow D}^{cl}$ thereby characterizes the classical coupling of the disturbance source to the shielding "reduced" to the radius $Ra_1$ (analogously for $Ri_1$). This "reduction" together with the multiplicative factor $Ra_1/R_2$ causes the coupling $L_{2\leftarrow D}$ to be much less weakened with respect to the classical value $L_{2\leftarrow D}^{cl}$ than is $L_{1\leftarrow D}$ with respect to $L_{1\leftarrow D}^{cl}$. Since the main and shielding coils are electrically connected in series, the inductive reaction of the shielding coil prevails over that of the main coil in the overall reaction of the magnet to the disturbance. This causes the resulting current changes in the magnet to amplify the disturbance field at the magnetic center. Depending on the exact arrangement of the magnet coils, the beta factor for homogeneous disturbances can deviate significantly from the classical value for shielded magnets $\beta^{cl}\approx 1$.

In total, the new coupling of the disturbance D to the magnet M is given by $$L_{M\leftarrow D}=L_{M\leftarrow D}^{cl}-\alpha L_{M\leftarrow D}^{cor} \tag{7}$$

with $$L_{M\leftarrow D}^{cor}=L_{1\leftarrow D}^{cl}-L_{(1,red,Ri1)\leftarrow D}^{cl}+\frac{Ra_1}{R_2}\left(L_{(2,red,Ra_1)\leftarrow D}^{cl}-L_{(2,red,Ri_1)\leftarrow D}^{cl}\right)$$

Analogous to the main coil, the disturbance flux is also expelled from the superconductor volume of the shielding. Since this volume is typically small compared to the superconductor volume of the main coil, this effect can be neglected.

Whether the disturbance field is produced by an external disturbance source or by a small current change in the magnet itself, is irrelevant for the mechanism of flux expulsion. For this reason, the self-inductance of the magnet also changes compared to the classical case. In particular, the following holds:

$$L_{1\leftarrow 1}=(1-\alpha)L_{1\leftarrow 1}^{cl}+\alpha L_{(1,red,Ri_1)\leftarrow 1}^{cl}$$

$$L_{1\leftarrow 2}=(1-\alpha)L_{1\leftarrow 2}^{cl}+\alpha L_{(1,red,Ri_1)\leftarrow 2}^{cl}$$

The other inductance changes are:

$$L_{2\leftarrow 2}=L_{2\leftarrow 2}^{cl}-\alpha\frac{Ra_1}{R_2}\left(L_{(2,red,Ra_1)\leftarrow 2}^{cl}-L_{(2,red,Ri_1)\leftarrow 2}^{cl}\right)$$

$$L_{2\leftarrow 1}=L_{2\leftarrow 1}^{cl}-\alpha\frac{Ra_1}{R_2}\left(L_{(2,red,Ra_1)\leftarrow 1}^{cl}-L_{(2,red,Ri_1)\leftarrow 1}^{cl}\right)$$

Altogether, one obtains for the new magnetic inductance:

$$L_m=L_M^{cl}-\alpha L_M^{cor} \tag{8}$$

with $$L_M^{cor}=L_{1\leftarrow 1}^{cl}-L_{(1,red,Ri1)\leftarrow 1}^{cl}+L_{1\leftarrow 2}^{cl}-L_{(1,red,Ri1)\leftarrow 2}^{cl}+\frac{Ra_1}{R_2}\left(L_{(2,red,Ra_1)\leftarrow 2}^{cl}-L_{(2,red,Ri_1)\leftarrow 1}^{cl}-L_{(2,red,Ri_1)\leftarrow 1}^{cl}\right)$$

Inserting the corrected coupling $L_{M\leftarrow D}$ between the magnet and disturbance source according to equation (7) into equation (3) instead of the classical inductive coupling $L_{M\leftarrow D}^{cl}$, and the corrected self inductance $L_M$ according to equation (8) instead of the classical self inductance $L_M^{cl}$, the beta factor becomes $$\beta=1-\frac{g_M}{g_D}\cdot\frac{L_{M\leftarrow D}}{L_M}=1-\frac{g_M}{g_D}\cdot\frac{L_{M\leftarrow D}^{cl}-\alpha L_{M\leftarrow D}^{cor}}{L_M^{cl}-\alpha L_M^{cor}} \tag{9}$$

In the following, the above formulas are generalized to the case with additional current paths P1, . . . , Pn.

For the direction M←Pj (a current change in Pj induces a current in M) the couplings between the magnet and the additional current paths (j=1, . . . , n) are reduced to the same degree as the corresponding coupling between the magnet and a disturbance coil:

$$L_{M\leftarrow Pj}=L_{M\leftarrow Pj}^{cl}-\alpha L_{M\leftarrow Pj}^{cor} \tag{10}$$

wherein $$L_{M\leftarrow Pj}^{cor}=L_{1\leftarrow Pj}^{cl}-L_{(1,red,Ri_1)\leftarrow Pj}^{cl}+\frac{Ra_1}{R_2}\left(L_{(2,red,Ra_1)\leftarrow Pj}^{cl}-L_{(2,red,Ri_1)\leftarrow Pj}^{cl}\right)$$

The new coupling $L_{Pj\leftarrow M}$ (a current change in M induces a current in Pj) is calculated as follows:

$$L_{Pj\leftarrow M}=L_{Pj\leftarrow M}^{cl}-\alpha L_{Pj\leftarrow M}^{cor} \tag{11}$$

with $$L_{Pj\leftarrow M}^{cor}=f_{Pj}\left(L_{(Pj,red,Ra_1)\leftarrow M}^{cl}-L_{(Pj,red,Ri_1)\leftarrow M}^{cl}\right)$$

For $R_{Pj}>Ra_1$ the coil Pj "reduced" to $Ra_1$ is again defined such that all windings are shrunk to the smaller radius $Ra_1$ (analogously for $Ri_1$). If, however, $Ri_1<R_{Pj}<Ra_1$, we take the coil "reduced" to $Ra_1$ as the coil Pj (the windings are not expanded to $Ra_1$). For $R_{Pj}<Ri_1$ we also take the coil "reduced" to $Ri_1$ as the coil Pj, i.e. in this case, the correction term to the classical theory equals zero.

For $R_{Pj}>Ra_1$ the constant $f_{Pj}$ is calculated by integrating (6) over the region $r>R_{Pj}$. For $R_{Pj}\leqq Ra_1$, $f_{Pj}=1$:

$$f_{Pj}=\begin{cases}\frac{Ra_1}{R_{Pj}}, & R_{Pj}>Ra_1\\ 1, & R_{Pj}<Ra_1\end{cases}$$

The corrections due to the properties of the superconductor thereby lead to asymmetric inductance matrices ($L_{M\leftarrow Pj}\neq L_{Pj\leftarrow M}$!).

The coupling $L_{Pj\leftarrow D}$ between an additional superconducting current path Pj and the disturbance coil D is also influenced to a greater or lesser degree by the expulsion of the flux of the disturbance field of the coil D from the superconductor material of the main coil:

$$L_{Pj\leftarrow D}=L_{Pj\leftarrow D}^{cl}-\alpha L_{Pj\leftarrow D}^{cor} \tag{12}$$

with $$L_{Pj\leftarrow D}^{cor}=f_{Pj}\left(L_{(Pj,red,Ra_1)\leftarrow D}^{cl}-L_{(Pj,red,Ri_1)\leftarrow d}^{cl}\right)$$

The couplings between the additional superconducting current paths are reduced to a greater or lesser degree in accordance with the same principle (paying attention to the sequence of the indices):

$$L_{Pj\leftarrow Pk}=L_{Pj\leftarrow Pk}^{cl}-\alpha L_{Pj\leftarrow Pk}^{cor} \tag{13}$$

with $$L_{Pj\leftarrow Pk}^{cor}=f_{Pj}\left(L_{(Pj,red,Ra_1)\leftarrow Pk}^{cl}-L_{(Pj,red,Ri_1)\leftarrow Pk}^{cl}\right)$$

(j=1, . . . , n; k=1, . . . , n.

In particular, the self-inductances (j=k) of the additional superconducting current paths are also influenced.

The actual beta factor of the system considered, having a superconducting (in particular actively shielded) magnet M and additional superconducting current paths P1, . . . , Pn is calculated with equation (4) for the classical beta factor, wherein the corrected values for the couplings $L_{M\leftarrow D}$, $L_{M\leftarrow Pj}$, $L_{Pj\leftarrow M}$, $L_{Pj\leftarrow D}$ and $L_{Pj\leftarrow Pk}$ according to (7), (10), (11), (12) and (13) are used:

$$\beta=1-g^T\cdot\left(L^{-1}\frac{L_{\leftarrow D}}{g_D}\right) \tag{14}$$

The variables in the formula are:

$g_D$: field per ampere of the coil D in the working volume without the field contributions of the currents induced in the additional current paths P1, . . . , Pn and in the magnet M, $$g^T=(g_M, g_{P1}, \ldots, g_{Pj}, \ldots, g_{Pn}),$$

wherein:

$g_M$: field per ampere of the magnet in the working volume without the field contributions of the currents induced in the additional current paths P1, . . . , Pn, $g_{Pj}$: field per ampere of the current path Pj in the working volume without the field contributions of the currents induced in the other additional current paths P1, . . . , Pn and in the magnet M, $$L=\begin{pmatrix}L_M^{cl} & L_{M\leftarrow Pl}^{cl} & \cdots & L_{M\leftarrow Pn}^{cl}\\ L_{Pl\leftarrow M}^{cl} & L_{Pl}^{cl} & \cdots & L_{Pl\leftarrow Pn}^{cl}\\ \vdots & \vdots & \ddots & \vdots\\ L_{Pn\leftarrow M}^{cl} & L_{Pn\leftarrow Pl}^{cl} & \cdots & L_{Pn}^{cl}\end{pmatrix}-\alpha\begin{pmatrix}L_M^{cor} & L_{M\leftarrow Pl}^{cor} & \cdots & L_{M\leftarrow Pn}^{cor}\\ L_{Pl\leftarrow M}^{cor} & L_{Pl}^{cor} & \cdots & L_{Pl\leftarrow Pn}^{cor}\\ \vdots & \vdots & \ddots & \vdots\\ L_{Pn\leftarrow M}^{cor} & L_{Pn\leftarrow Pl}^{cor} & \cdots & L_{Pn}^{cor}\end{pmatrix}$$

corrected inductance matrix, $L^{-1}$ inverse of the corrected inductance matrix, $$L_{\leftarrow D}=\begin{pmatrix}L_{M\leftarrow D}^{cl}\\ L_{Pl\leftarrow D}^{cl}\\ \vdots\\ L_{Pn\leftarrow D}^{cl}\end{pmatrix}-\alpha\begin{pmatrix}L_{M\leftarrow D}^{cor}\\ L_{Pl\leftarrow D}^{cor}\\ \vdots\\ L_{Pn\leftarrow D}^{cor}\end{pmatrix}$$

vector of the corrected couplings to the disturbance coil D.

If a current path Pj comprises partial coils at different radii, the matrix elements in the correction terms $L^{cor}$ and $L_{\leftarrow D}^{cor}$, which belong to Pj must be calculated such that each partial coil is initially treated as an individual current path and the correction terms of all partial coils are then added together. This sum is the matrix element of the current path Pj.

The beta factor of a magnet depends on the exact properties of the disturbance field. Below, we assume a simple disturbance source, i.e. a round conductor loop which is coaxial with the magnet at the height of the magnetic center. The beta factor of the magnet with respect to this loop can be determined experimentally by introducing a current into the loop and measuring the field shift at the magnetic center. The classical model permits calculation of the beta factor as a function of the radius of the loop which typically leads to a calculated dependence as shown in FIG. 2. In the example shown therein, the outer radius of the shielding coil was assumed to be twice the size of the outer radius of the main coil. The dipole moments of main coil and shielding coil are equal and opposite.

According to the inventive model, the actual beta factor can be calculated in dependence on the radius of the disturbance loop. This beta factor is shown in FIG. 3 for $\alpha=0.33$. The difference between the two curves is shown in FIG. 4 as a function of the radius of the disturbance loop.

It can be qualitatively observed that the largest deviation from the classical theory occurs when the radius of the disturbance loop is large. In this case, the classical couplings of the disturbance loop to the main coil and to the shielding have the same magnitude, however opposite signs. The special diamagnetic properties of the superconductor cause highly different attenuations of these couplings (the disturbance flux through the main coil is more reduced than that through the shielding) and therefore, the more strongly weighted inductive response of the shielding becomes particularly apparent.

If the disturbance loop is at the outer radius $Ra_1$ of the main coil or radially further inside, its classical coupling to the shielding is much smaller than its classical coupling to the main coil, i.e. the total coupling of the disturbance loop to the magnet substantially corresponds to the coupling to the main coil. Weakening of the coupling of the disturbance loop to the magnet is then mainly caused by a weakening of its coupling to the main coil which is approximately equal to the weakening of the self-inductance of the magnet. Since the reaction of the magnet to the disturbance depends on the ratio of the self-inductance to the disturbance coupling, the correction terms cancel and the parameter $\alpha$ is almost invisible in this case. For this reason, in unshielded magnets, field expulsion from the superconductor volume also has no substantial influence on the beta factor of the magnet.

In a first approximation, the parameter $\alpha$ is the superconductor portion of the coil volume of the main coil. The most precise fashion for determining the parameter $\alpha$ is to perform a disturbance experiment for the magnet without additional current paths. The last section above shows that disturbance loops having large radii are particularly suited therefor. The following procedure is recommended:

1. Experimental determination of the beta factor $\beta^{exp}$ of the magnet with respect to a disturbance which is substantially homogeneous in the area of the magnet (e.g. with a loop of large radius).
2. Theoretical determination of the beta factor $\beta^{cl}$ with respect to the same disturbance source using the classical theory according to equation (3).
3. Determination of the parameter $\alpha$ from equation $$\alpha = \frac{(g_D(L_M^{cl}))^2(\beta^{exp} - \beta^{cl})}{g_D(\beta^{exp} - \beta^{cl})L_M^{cl}L_M^{cor} - g_M(L_{M\leftarrow D}^{cl}L_M^{cor} - L_{M\leftarrow D}^{cor}L_M^{cl})}.$$

We claim:

1. A superconducting magnet system for generating a magnetic field in a direction of a z axis in a working volume disposed about z=0, the magnet system being able to react inductively to a, within a magnet volume substantially homogeneous, disturbance field produced by a disturbance coil (D), the magnet system comprising:

at least one current-carrying magnet coil (M); and at least one additional superconductingly closed current path (P1, . . . , Pn), which can react inductively to changes of the magnetic flux through the area enclosed by it, wherein the magnetic fields in the z direction generated by these additional current paths during operation and in response to induced currents do not exceed 0.1 Tesla in the working volume, wherein said magnet coil(s) (M) and said current path (P1, . . . , Pn) are designed such that, when the additional disturbance coil (D) produces a substantially homogeneous disturbance field in the magnet volume, a value $$\beta = 1 - g^T \cdot \left( (L^{cl} - \alpha L^{cor})^{-1} \frac{(L_{\leftarrow D}^{cl} - \alpha L_{\leftarrow D}^{cor})}{g_D} \right)$$

differs by more than 0.1 from a value $$\beta_0 = 1 - g^T \cdot \left( (L^{cl})^{-1} \frac{L_{\leftarrow D}^{cl}}{g_D} \right)$$

which would result if $\alpha$=0, wherein:

–$\alpha$: is an average magnetic susceptibility in the volume of said magnet coil(s) (M) with respect to field fluctuations which do not exceed a magnitude of 0.1 T, with $0<\alpha\leqq 1$, and $$g^T=(g_M, g_{P1}, \ldots, g_{Pj}, \ldots, g_{Pn}),$$

wherein $g_{Pj}$: is a field per ampere of said current path Pj in the working volume without field contributions of said current paths Pi for i≠j and said magnet coil(s) (M), $g_M$: is a field per ampere of said magnet coil(s) (M) in the working volume without the field contributions of said current paths (P1, . . . ,Pn), $g_D$: is a field per ampere of the disturbance coil (D) in the working volume without field contributions of said current paths (P1 , . . . ,Pn) and said magnet coil(s) (M), $L^{cl}$: is a matrix of inductive couplings between said magnet coil(s) and said current paths (P1, . . . ,Pn) and among said current paths (P1, . . . ,Pn), $L^{cor}$: is a correction for said inductance matrix $L^{cl}$, which would result with complete diamagnetic expulsion of disturbance fields from the volume of said magnet coil(s) (M), $L_{77\ D}^{cl}$: is a vector of inductive couplings of the disturbance coil (D) with said magnet coil(s) and said current paths (P1, . . . ,Pn), and $L_{\leftarrow D}^{cor}$: is a correction for said coupling vector $L_{\leftarrow D}^{cl}$, which would result with complete diamagnetic expulsion of disturbance fields from the volume of said magnet coil(s) (M).

2. The magnet system of claim 1, wherein said superconducting magnet coil(s) (M) comprise(s) a radially inner and a radially outer coaxial coil system (C1, C2) which are electrically connected in series, wherein these two coil systems each produce a magnetic field in the working volume having opposing direction along the z axis.

3. The magnet system of claim 2, wherein said radially inner coil system (C1) and said radially outer coil system (C2) have dipole moments approximately equal in value and opposite in sign.

4. The magnet system of claim 1, wherein said magnet coil(s) (M) form a first superconductingly short-circuited current path during operation and that one disturbance compensation coil, which is not galvanically connected to said magnet coil(s) (M), is disposed coaxially to said magnet coil(s) (M) to form said additional current path (P1) and which is superconductingly short-circuited during operation.

5. The magnet system of claim 1, wherein at least one of said additional current path (P1, . . . , Pn) consists essentially of a portion of said magnet coil(s) (M), bridged by a superconducting switch.

6. The magnet system of claim 4, wherein said current paths and said magnet coil are at least substantially inductively decoupled from one another.

7. The magnet system of claim 5, wherein said current paths and said magnet coil are at least substantially inductively decoupled from one another.

8. The magnet system of claim 6, wherein, for inductive decoupling, a different polarity of a radially inner and a radially outer coil system is utilized.

9. The magnet system of claim 7, wherein, for inductive decoupling, a different polarity of a radially inner and a radially outer coil system is utilized.

10. The magnet system of claim 1, wherein the magnet system is part of an apparatus for high-resolution magnetic resonance spectroscopy.

11. The magnet system of claim 10, wherein said magnetic resonance spectroscopy apparatus comprises a means for field locking the magnetic field produced in the working volume.

12. The magnet system of claim 1, wherein the magnet system comprises field modulation coils.

13. The magnet system of claim 1, wherein at least one of said additional current paths (P1, . . . , Pn) comprises a superconductingly closed coil which is electrically separated from said magnet coil(s).

14. The magnet system of claim 1, wherein said value of $$\beta = 1 - g^T \cdot \left( (L^{cl} - \alpha L^{cor})^{-1} \frac{(L^{cl}_{\leftarrow D} - \alpha L^{cor}_{\leftarrow D})}{g_D} \right)$$

is smaller than 0.1.

15. A method for dimensioning coils in a superconducting magnet system, the super conducting magnet system generating a magnetic field in a direction of a z axis in a working volume disposed about z=0, the magnet system being able to react inductively to a, within the magnet volume substantially homogeneous, disturbance field produced by a disturbance coil (D), the method comprising the step of:

calculating a portion β of an external field disturbance which enters the working volume of said magnet system by taking into consideration current changes induced in a magnet coil(s) (M) and in additional current paths (P1, . . . , Pn) according to:

$$\beta = 1 - g^T \cdot \left( (L^{cl} - \alpha L^{cor})^{-1} \frac{(L^{cl}_{\leftarrow D} - \alpha L^{cor}_{\leftarrow D})}{g_D} \right),$$

wherein:

–α: is an average magnetic susceptibility in a volume of said magnet coil(s) (M) with respect to field fluctuations which do not exceed 0.1 T, with 0<α<1, and $$g^T = (g_M, g_{P1}, \ldots, g_{Pj}, \ldots, g_{Pn}),$$

wherein $g_{Pj}$: is a field per ampere of said current path Pj in the working volume without field contributions of said current paths Pi for i≠j and said magnet coil(s) (M), $g_M$: is a field per ampere of said magnet coil(s) (M) in the working volume without field contributions of said current paths (P1, . . . , Pn), $g_D$: is a field per ampere of the disturbance coil (D) in the working volume without field contributions of said current paths (P1, . . . , Pn) and said magnet coil(s) (M), $L^{cl}$: is a matrix of inductive couplings between said magnet coil(s) and said current paths (P1, . . . , Pn) and among said current paths (P1, . . . , Pn), $L^{cor}$: is a correction for said inductance matrix $L^{cl}$, which would result with complete diamagnetic expulsion of disturbance fields from the volume of said magnet coil(s) (M), $L_{\leftarrow D}{}^{cl}$: is a vector of the inductive couplings of the disturbance coil (D) with said magnet coil(s) (M) and said current paths (P1, . . . , Pn), and $L_{\leftarrow D}{}^{cor}$: is a correction for said coupling vector $L_{\leftarrow D}{}^{cl}$, which would result with complete diamagnetic expulsion of disturbance fields from the volume of said magnet coil(s) (M).

16. The method of claim 15, wherein a corresponds to a volume portion of superconductor material compared to a total volume of said magnet coil(s) (M).

17. The method of claim 15, further comprising determining α experimentally by measuring a value $\beta^{exp}$ of said magnet coil(s) (M), without said additional current paths (P1, . . . , Pn), in response to the disturbance coil (D) through insertion of said value $\beta^{exp}$ into an equation:

$$\alpha = \frac{(g_D(L^{cl}_M))^2(\beta^{exp} - \beta^{cl})}{g_D(\beta^{exp} - \beta^{cl})L^{cl}_M L^{cor}_M - g_M(L^{cl}_{M\leftarrow D}L^{cor}_M - L^{cor}_{M\leftarrow D}L^{cl}_M)},$$

wherein $$\beta^{cl} = 1 - g_M \cdot \left( \frac{L^{cl}_{M\leftarrow D}}{L^{cl}_M \cdot g_D} \right),$$

$g_M$: is said field per ampere of said magnet coil(s) (M) in the working volume, $g_D$: is said field per ampere of the disturbance coil (D) in the working volume without field contribution of said magnet coil(s) (M), $L_M{}^{cl}$: is an inductance of said magnet coil(s) (M), $L_{M\leftarrow D}{}^{cl}$: is an inductive coupling of the disturbance coil (D) to said magnet coil(s) (M), $L_M{}^{cor}$: is a correction for said magnet inductance $L_M{}^{cl}$, which would result with complete diamagnetic expulsion of disturbance fields from the volume of said magnet coil(s) (M), $L_{M\leftarrow D}{}^{cor}$: is a correction for said inductive coupling $L_{M\leftarrow D}{}^{cl}$ of the disturbance coil (D) with said magnet coil(s) (M) which would result with complete diamagnetic expulsion of disturbing fields from the volume of said magnet coil(s) (M), $$\beta^{exp} = \frac{g_D^{eff}}{g_D},$$

and $g_D{}^{eff}$: a measured field change in the working volume of the magnet system per ampere of current in the disturbance coil (D).

18. The method of claim 15, wherein said corrections $L^{cor}$, $L_{\leftarrow D}{}^{cor}$, $L_M{}^{cor}$ and $L_{M\leftarrow D}{}^{cor}$ are calculated as follows:

$$L^{cor} = \begin{pmatrix} L^{cor}_M & L^{cor}_{M\leftarrow P1} & \cdots & L^{cor}_{M\leftarrow Pn} \\ L^{cor}_{P1\leftarrow M} & L^{cor}_{P1} & \cdots & L^{cor}_{P1\leftarrow Pn} \\ \vdots & \vdots & \ddots & \vdots \\ L^{cor}_{Pn\leftarrow M} & L^{cor}_{Pn\leftarrow P1} & \cdots & L^{cor}_{Pn} \end{pmatrix},$$

-continued $$L_{\leftarrow D}^{cor} = \begin{pmatrix} L_{M\leftarrow D}^{cor} \\ L_{Pl\leftarrow D}^{cor} \\ \vdots \\ L_{Pn\leftarrow D}^{cor} \end{pmatrix},$$

$$L_{Pj\leftarrow Pk}^{cor} = f_{Pj}(L_{(Pj,red,Ra_1)\leftarrow Pk}^{cl} - L_{(Pj,red,Ri_1)\leftarrow Pk}^{cl}),$$

$$L_{Pj\leftarrow D}^{cor} = f_{Pj}(L_{(Pj,red,Ra_1)\leftarrow D}^{cl} - L_{(Pj,red,Ri_1)\leftarrow D}^{cl}),$$

$$L_{Pj\leftarrow M}^{cor} = f_{Pj}(L_{(Pj,red,Ra_1)\leftarrow M}^{cl} - L_{(Pj,red,Ri_1)\leftarrow M}^{cl}),$$

$$L_{M\leftarrow Pj}^{cor} = L_{1\leftarrow Pj}^{cl} - L_{(1,red,Ri_1)\leftarrow Pj}^{cl} + \frac{Ra_1}{R_2}\left(L_{(2,red,Ra_1)\leftarrow Pj}^{cl} - L_{(2,red,Ri_1)\leftarrow Pj}^{cl}\right),$$

$$L_{M\leftarrow D}^{cor} = L_{1\leftarrow D}^{cl} - L_{(1,red,Ri1)\leftarrow D}^{cl} + \frac{Ra_1}{R_2}\left(L_{(2,red,Ra_1)\leftarrow D}^{cl} - L_{(2,red,Ri_1)\leftarrow D}^{cl}\right),$$

$$L_M^{cor} = L_{1\leftarrow 1}^{cl} - L_{(1,red,Ri1)\leftarrow 1}^{cl} + L_{1\leftarrow 2}^{cl} - L_{(1,red,Ri1)\leftarrow 2}^{cl}$$

$$L_M^{cor} = L_{1\leftarrow 1}^{cl} - L_{(1,red,Ri1)\leftarrow 1}^{cl} + L_{1\leftarrow 2}^{cl} - L_{(1,red,Ri1)\leftarrow 2}^{cl} +$$

-continued $$\frac{Ra_1}{R_2}\left(L_{(2,red,Ra_1)\leftarrow 2}^{cl} - L_{(2,red,Ri_1)\leftarrow 1}^{cl} - L_{(2,red,Ri_1)\leftarrow 1}^{cl}\right)$$

wherein $Ra_1$: is one of an outside radius of said magnet coil(s) (M) and, in an actively shielded magnet arrangement, an outside radius of a main coil (C1), $Ri_1$: is an inside radius of said magnet coil(s) (M), $R_2$: is an average radius of a shielding (C2) in an actively shielded magnet arrangement and, in a magnet arrangement without active shielding, infinite, $R_{Pj}$: an average radius of said additional coil Pj, $$f_{Pj} = \begin{cases} \frac{Ra_1}{R_{Pj}}, & R_{Pj} > Ra_1 \\ 1, & R_{Pj} < Ra_1 \end{cases}$$

and wherein, for an actively shielded magnet arrangement, said index 1 characterizes said main coil (C1) and otherwise said magnet coil(s) (M), and, for an actively shielded magnet arrangement, said index 2 characterizes said shielding (C2), while otherwise terms of index 2 are omitted, and said index (X, red, R) characterizes a hypothetical coil having all windings of a coil X at a radius R.

* * * * *